US009257803B2

(12) United States Patent
Alagna et al.

(10) Patent No.: US 9,257,803 B2
(45) Date of Patent: Feb. 9, 2016

(54) POWER STRIP HOLDER

(71) Applicants: Giuseppe Alagna, Whitestone, NY (US); Francesco S. Lupo, Staten Island, NY (US)

(72) Inventors: Giuseppe Alagna, Whitestone, NY (US); Francesco S. Lupo, Staten Island, NY (US)

( * ) Notice: Subject to any disclaimer, the term of this patent is extended or adjusted under 35 U.S.C. 154(b) by 0 days.

(21) Appl. No.: 14/618,451

(22) Filed: Feb. 10, 2015

(65) Prior Publication Data

US 2015/0318648 A1 Nov. 5, 2015

Related U.S. Application Data

(60) Provisional application No. 61/987,851, filed on May 2, 2014.

(51) Int. Cl.
*H01R 13/73* (2006.01)
*H01R 25/00* (2006.01)
*H01R 13/72* (2006.01)

(52) U.S. Cl.
CPC ..... *H01R 25/006* (2013.01); *H01R 13/72* (2013.01); *H01R 13/73* (2013.01)

(58) Field of Classification Search
CPC .. A45C 2013/025; A45C 13/02; A45C 15/00; A45C 3/02; A45C 2011/003; A45C 9/00; A45C 11/00; A45C 11/008; A45C 13/08; A45C 15/06; A45C 5/005; B25H 3/02; B25H 3/023
See application file for complete search history.

(56) References Cited

U.S. PATENT DOCUMENTS

| | | | | | |
|---|---|---|---|---|---|
| 3,049,688 | A * | 8/1962 | Sinopoli | 439/501 |
| 4,408,813 | A * | 10/1983 | Koehler | 439/148 |
| 4,875,878 | A * | 10/1989 | Meyer | 439/501 |
| 4,984,685 | A * | 1/1991 | Douglas | 206/702 |
| 5,103,977 | A * | 4/1992 | Douglas | 206/702 |
| 5,238,416 | A * | 8/1993 | Dickie | 439/148 |
| 5,339,956 | A * | 8/1994 | Thomason | 206/372 |
| 5,344,339 | A * | 9/1994 | Cheslock | 439/501 |
| 5,503,571 | A * | 4/1996 | Cheslock | 439/501 |
| 5,810,168 | A * | 9/1998 | Eggering | 206/372 |
| 5,848,701 | A * | 12/1998 | Riccabona | 206/702 |
| 5,915,641 | A * | 6/1999 | Barberg | 242/395.1 |
| D428,598 | S * | 7/2000 | Carter-Williams et al. | D13/154 |
| 6,138,827 | A * | 10/2000 | Marshall | 206/373 |
| 6,968,955 | B2 * | 11/2005 | Steeber | 206/702 |
| 7,017,773 | B2 * | 3/2006 | Gruber et al. | 220/675 |
| 7,334,680 | B2 * | 2/2008 | Cunningham et al. | 206/372 |
| 7,435,901 | B2 * | 10/2008 | Mori et al. | 174/53 |
| 7,625,241 | B2 * | 12/2009 | Axland et al. | 439/640 |
| 8,598,453 | B2 * | 12/2013 | Hsiao | 220/3.2 |
| 8,662,300 | B1 * | 3/2014 | Arena | 206/373 |
| 2002/0130133 | A1 * | 9/2002 | Immerman et al. | 220/630 |
| 2004/0121225 | A1 * | 6/2004 | Krieger et al. | 429/96 |
| 2008/0023358 | A1 * | 1/2008 | Otto | 206/349 |
| 2008/0277133 | A1 * | 11/2008 | Axland et al. | 174/54 |

* cited by examiner

*Primary Examiner* — Briggitte R Hammond
(74) *Attorney, Agent, or Firm* — Carter, DeLuca, Farrell & Schmidt, LLP

(57) ABSTRACT

A combination storage receptacle and power strip/surge protector holder includes an enclosure perimeter defining an aperture for receiving objects, and a power strip mounted to the enclosure perimeter for reducing the clutter of wiring of power strips.

20 Claims, 14 Drawing Sheets

POWER STRIP HOLDER

CROSS-REFERENCE TO RELATED APPLICATION

This application claims the benefit of and priority to U.S. Provisional Patent Application No. 61/987,851 filed on May 2, 2014, the entire contents of which are incorporated by reference herein.

BACKGROUND

Despite the advance of "wireless" technology, in fact, wires remain an integral part of a home, office, commercial or industrial environment. As a result, there remains a clutter of wires which must be connected to one or more power strips or to one or more combination power strips and surge protectors.

The average user must locate the one or more power strips or the one or more combination power strips and surge protectors in a free standing manner which contributes to the clutter of wires.

SUMMARY

In one aspect, the embodiments of the present disclosure relate to a combination storage receptacle and power strip holder wherein a storage receptacle includes an enclosure perimeter that defines an aperture for receiving objects therein and at least one power strip is mounted to the enclosure perimeter for reducing the clutter of wiring of the power strips.

In one embodiment, a storage receptacle is provided and includes an enclosure perimeter and at least one power strip configured to be coupled to the enclosure perimeter. The enclosure perimeter defines an aperture for receiving objects therein.

In some embodiments, the power strip may be mounted to the enclosure perimeter via a mounting structure such that the mounting structure is mounted to the enclosure perimeter and the power strip is mounted to the mounting structure. It is contemplated that the power strip may be mounted to the enclosure perimeter via an adhesive material.

In some aspects, the aperture defined by the enclosure perimeter may have a generally rectangular configuration or a generally circular configuration.

In some embodiments, the storage receptacle may further include a base portion and a storage receptacle structure mounted to the base portion. The base portion defines a portion of the enclosure perimeter. The power strip may be mounted to the storage receptacle structure.

In yet another embodiment, a power strip or surge protector support structure is provided. The support structure includes an enclosure perimeter including an inner surface and an outer surface. The inner surface defines an aperture configured for receiving a storage receptacle therein. The outer surface defines a cavity configured for receiving and supporting a power strip therein.

In some embodiments, the power strip may be mounted to the outer surface of the enclosure perimeter and disposed within the at least one cavity.

It is contemplated that the storage receptacle may be removably disposed within the aperture of the enclosure perimeter. The support structure may further include a shroud member disposed within the aperture of the enclosure perimeter. The shroud member is configured to direct the storage receptacle into the enclosure perimeter.

It is envisioned that the outer surface may include four channel members connected to one another to form a square configuration. Each channel member may be configured for receipt of a rectangular power strip.

In one aspect, the shroud member may define an aperture exhibiting a generally rectangular configuration for receiving the storage receptacle.

In yet another aspect of the present disclosure, a receptacle assembly is provided and includes a receptacle, a power strip or a surge protector, and a base station. The receptacle has a top portion and a bottom portion. The top portion defines a cavity therein. The base station is configured to have the power strip or the surge protector mounted thereto. The base station is further configured to be coupled to the bottom portion of the receptacle.

In some embodiments, the bottom portion of the receptacle may be detachably coupled to the base station.

It is contemplated that the base station may include an underside and a wall extending upwardly from the underside. The wall may define a cavity therein configured for receipt of the bottom portion of the receptacle. The wall may have a side surface that defines an opening therethrough configured for receipt of the power strip or the surge protector. The opening may be in communication with the cavity of the receptacle.

It is envisioned that the underside of the base station may define a cavity therein. The base station may further include a cylindrical extension disposed within the cavity of the underside. The cylindrical extension may be configured to have an electric cord of the power strip or the surge protector wrapped thereabout. The cylindrical extension may define a passageway therethrough having a first opening in communication with the cavity of the wall and a second opening in communication with the cavity of the underside. The passageway may be configured for passage of the electric cord.

In some embodiments, the cylindrical extension may define at least one longitudinally extending slit. The cylindrical extension may have a radially extending flange to retain the electric cord within the cavity of the underside. The underside of the base station may define a channel therein extending laterally from the cavity of the underside to an outside surface of the underside. The channel may be configured for receipt of the electrical cord. The channel of the underside may be perpendicular to the longitudinally extending slit and in alignment therewith.

In some embodiments, the receptacle assembly may further include a barrier configured for receipt within the base station and in engagement with the surge protector or the power strip. The barrier may define a cavity therein configured for removable receipt of the bottom portion of the receptacle. The barrier may have a plurality of fingers configured to engage the surge protector or the power strip. Adjacent fingers of the plurality of fingers may define a space therebetween configured for passage of an electric cord of the surge protector or the power strip.

BRIEF DESCRIPTION OF THE DRAWINGS

These and other advantages will become more apparent from the following detailed description of the various embodiments of the present disclosure with reference to the drawings wherein.

DETAILED DESCRIPTION

To reduce the clutter of wiring, there is disclosed herein various embodiments of a storage receptacle that is combined with a power strip or surge protector. Thus, the storage receptacle is a power strip holder. The present disclosure relates also to a storage receptacle structure into which a storage receptacle may be inserted and one or more power strips may be installed on the storage receptacle structure.

As defined herein, a power strip is an electrical device which includes a cord which may include a plug and includes a body portion to which the cord is connected. The body portion of the power strip includes several sockets or receptacles. The power strip may include a surge protector or surge protection features or a combination thereof. The power strip with or without surge protection features may be of varying shapes such as rectangular or circular or polygonal, etc. The power strip or surge protector generally includes a power cord attached thereto for supplying electrical power or an internet feed or telephone connection for communications purposes, etc., either one of which may be optical in nature. The sockets or receptacles of the power strip may be designed for interfacing with equipment that is supplied such electrical power or communications or optical networks via the power strip or surge protector.

As further defined herein, reference to a power strip may refer to a power strip alone without a surge protector or to a power strip that includes surge protection features incorporated there within.

As one example, a representative power strip as defined herein may be a Belkin 7 Outlet Home/Office Surge Protector with Power Cord (manufactured by Belkin International, Inc., Playa Vista, Calif., USA). Other power strips as currently known in the art or to become available may be adapted for application as described herein below.

As defined herein, an enclosure perimeter refers to one or more surfaces of a storage receptacle that includes side or lateral walls or lower or bottom walls of the storage receptacle.

As defined herein, a power strip or surge protector support structure may include an enclosure perimeter defining an aperture configured and dimensioned for receiving a storage receptacle therein. A power strip or surge protector support structure may include a surface that is configured and dimensioned to interface with the enclosure perimeter of a storage receptacle. A power strip or surge protector support structure may also be configured and dimensioned to define a perimeter for receiving and supporting at least one power strip or surge protector disposed on the perimeter.

Figure 1:
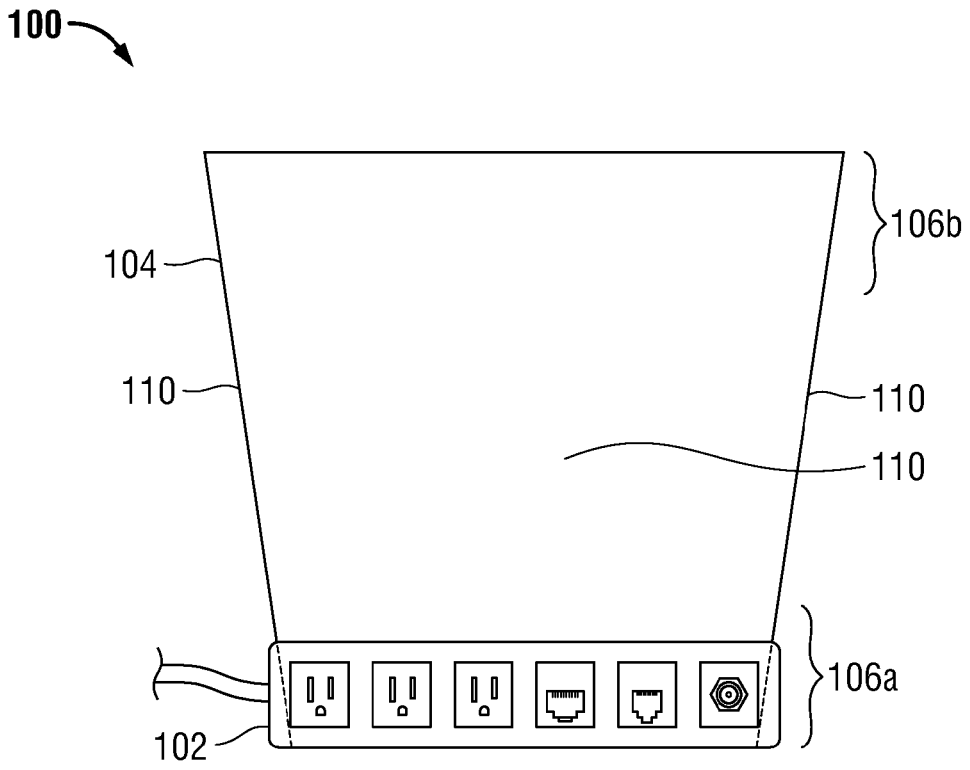
FIG. 1 is an elevation view of a storage receptacle having a power strip or surge protector mounted thereon according to one embodiment of the present disclosure.
Figure 2:
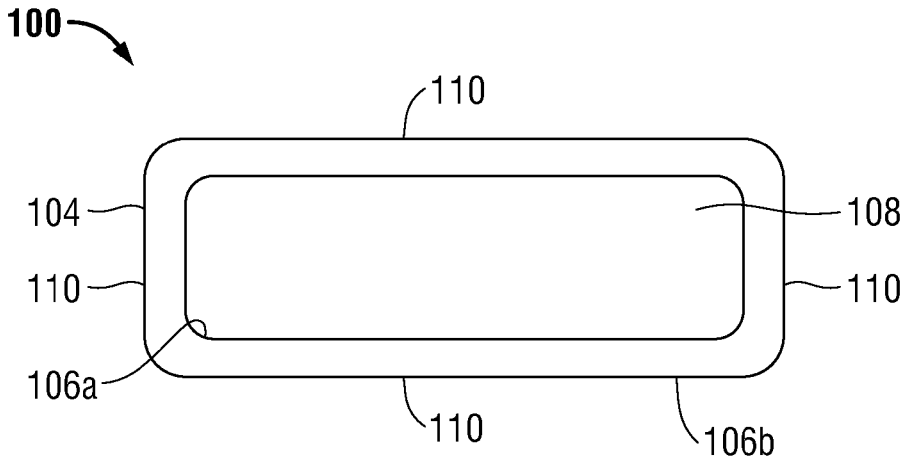
FIG. 2 is a top view of the storage receptacle of FIG. 1 illustrating an aperture formed within an enclosure perimeter of the storage receptacle of FIG. 1.

FIG. 1 illustrates a combination storage receptacle and power strip 100 wherein at least one power strip or surge protector 102 is mounted on a storage receptacle 104 according to one embodiment of the present disclosure. The storage receptacle 104 defines a base portion 106*a* and a first power strip or surge protector 102 may be mounted to the storage receptacle 104 at the base portion 106. FIG. 2 is a top view of the combination storage receptacle and power strip 100 of FIG. 1 illustrating an aperture 108 formed within an enclosure perimeter 110 defined by the storage receptacle 104. As can be seen in FIG. 1, the power strip or surge protector 102 may be mounted to a portion of the enclosure perimeter 110 of the storage receptacle 104 at the base portion 106*a*. The aperture 108 extends from an upper portion 106*b* of the storage receptacle 104 to the base portion 106*a*. Thus, the base portion 106*a* and the upper portion 106*b* each define a portion of the enclosure perimeter 110. The power strip or surge protector 102 may thus be mounted to the base portion 106*a*. The base portion 106*a* may support objects received through the aperture 108 defined by the enclosure perimeter 110.

Figure 3:
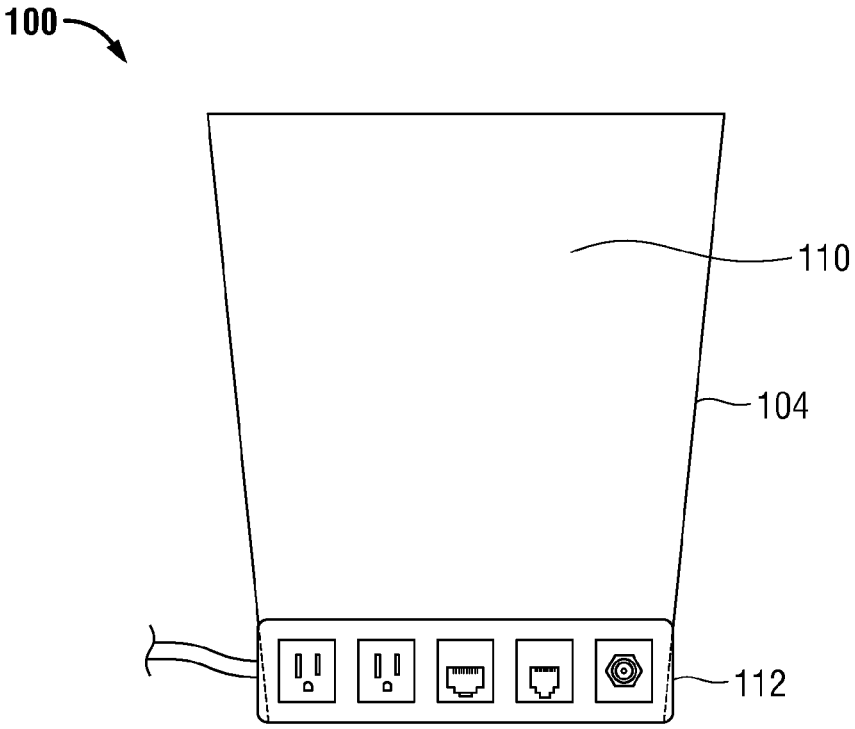
FIG. 3 is another elevation view of the storage receptacle of FIGS. 1 and 2 having a power strip or surge protector mounted thereon according to one embodiment of the present disclosure.

FIG. 3 is another elevation view of the combination storage receptacle and power strip 100 of FIG. 1 wherein at least another or second power strip or surge protector 112 is mounted on another portion of the enclosure perimeter 110 of the storage receptacle 104 according to one embodiment of the present disclosure.

Figure 4:
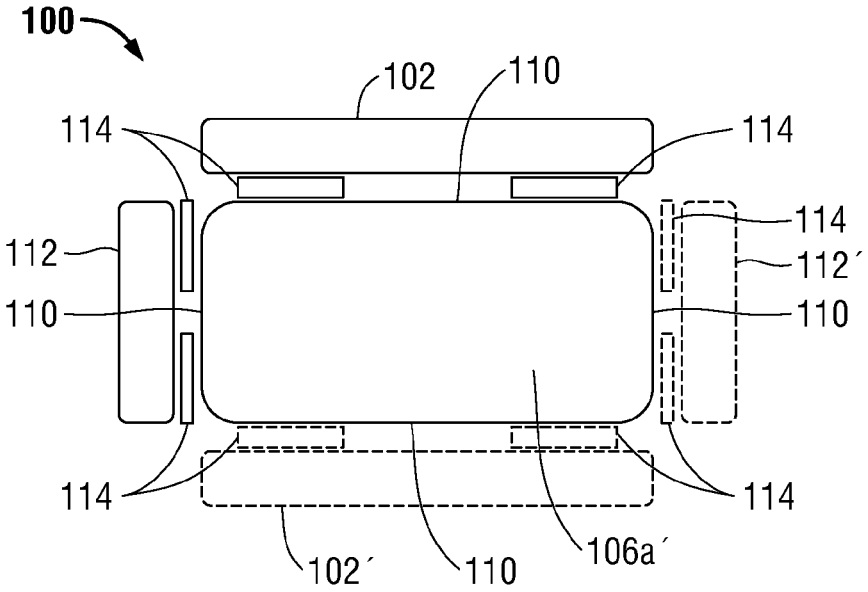
FIG. 4 is a view of a bottom end of the storage receptacle of FIGS. 1, 2 and 3 having a plurality of power strips or surge protectors mounted thereon.

FIG. 4 is a view of a bottom end or lower surface 106*a*' of the combination storage receptacle and power strip 100 of FIGS. 1 and 2 having a plurality of power strips or surge protectors 102 and 112 mounted on the enclosure perimeter 110 of the storage receptacle 104. In one embodiment, an additional or third power strip or surge protector 102' may be mounted on another portion of the enclosure perimeter 110 opposite to the first power strip or surge protector 102 and still another or fourth power strip or surge protector 112' may be mounted on still another portion of the enclosure perimeter 110 opposite to the second power strip or surge protector 112.

Both the third power strip or surge protector 102' and the fourth power strip or surge protector 102' are shown via dashed lines in FIG. 4 since at least one may be present on the combination storage receptacle and power strip 100. Additionally, either the first power strip or surge protector 102 or the second power strip or surge protector 112 may be present alone or together on the storage receptacle 104. The storage receptacle 104 may include any one or more of the power strips or surge protectors that are suitable for the intended usage.

As can be appreciated from the foregoing description of FIGS. 1-4, the aperture 108 defined by the enclosure perimeter 110 may exhibit a generally rectangular configuration.

In addition to reducing the clutter of wiring, the presence of one or more power strips or surge protectors on the storage receptacle 104 serves to increase the stability of the storage receptacle by reducing the probability of tipping over unintentionally.

As further illustrated in FIG. 4, the one or more power strips 102, 102', 112, 112' may be mounted to the enclosure perimeter via strips of adhesive material 114 that are disposed between the one or more power strip or surge protectors 102, 102', 112, 112' and the enclosure perimeter 110 of the storage receptacle 104. The adhesive material 114 may include a suitable chemical bonding material as known in the art such as polyurethane as one of many examples. Alternatively, a physical bonding material also as known in the art such as Velcro™ that is itself adhered to the surface of the enclosure perimeter 110 may be utilized.

Figure 5:
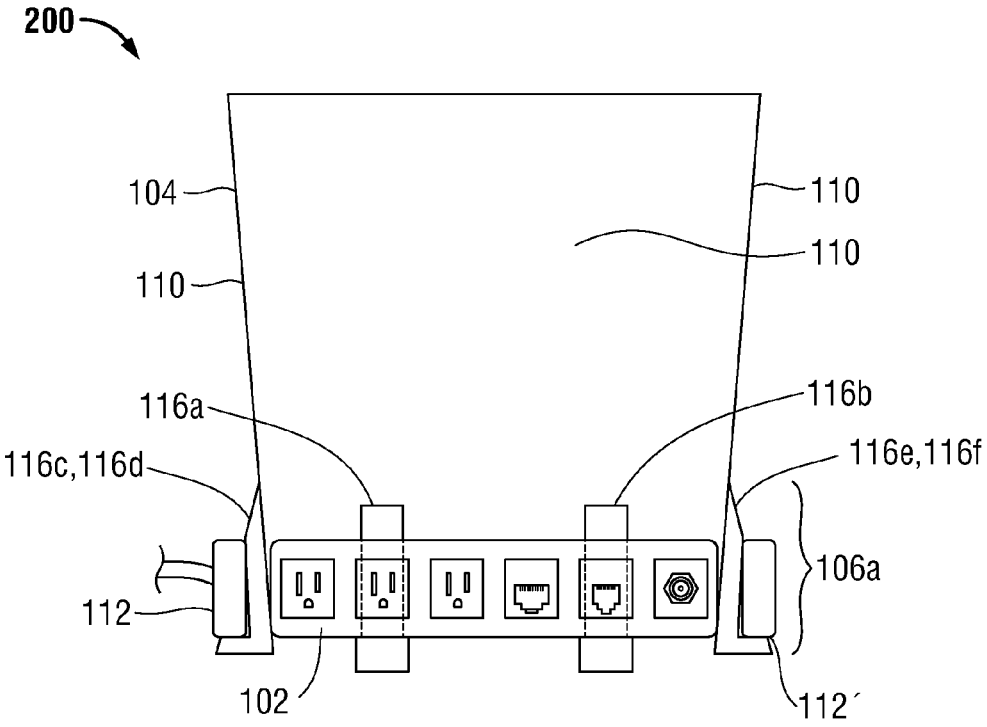
FIG. 5 is an elevation view of a storage receptacle having a power strip or surge protector mounted thereon via one or more mounting brackets according to one embodiment of the present disclosure.
Figure 6:
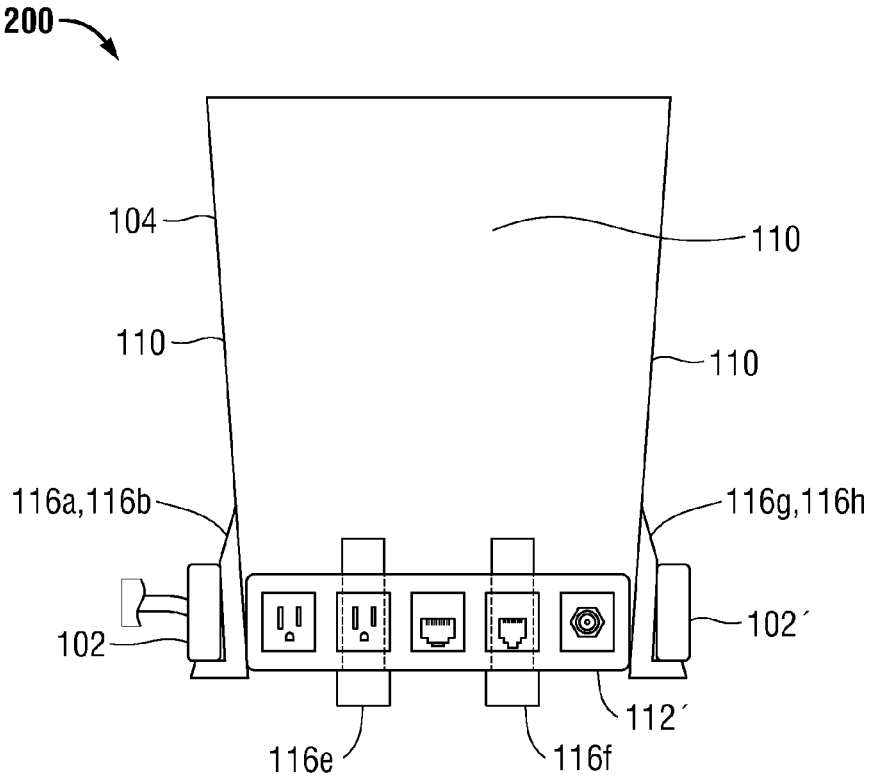
FIG. 6 is another elevation view of the storage receptacle of FIG. 5 showing the one or more mounting brackets supporting one or more power strips or surge protectors.

FIGS. 5-6 illustrate an alternate embodiment of the combination storage receptacle and power strip 100 of FIGS. 1-4. Combination storage receptacle and power strip 200 is identical to the combination storage receptacle and power strip 100 except that instead of the one or more power strips 102, 102', 112, 112' being mounted to the enclosure perimeter 110 via strips of adhesive material 114, the one or more power strips 102, 102', 112, 112' are mounted to the enclosure perimeter 110 via at least one mounting structure 116*a*-116*h*, e.g., such as angle brackets that are shown in FIGS. 5 and 6, such that the one or more power strips 102, 102', 112, 112' are mounted to the enclosure perimeter 110 and the one or more power strips 102, 102', 112, 112' are mounted to the one or more mounting structures 116*a*-116*f*.

Those skilled in the art will recognize that mounting structures other than angle brackets may be employed to mount the one or more power strips 102, 102', 112, 112' to the enclosure perimeter 110. For example, a channel (not shown) which extends across the enclosure perimeter 110 may be configured such that a power strip may be inserted and slid through the channel. The mounting structures 116*a*-116*f* may be made preferably from an electrically insulating material and may be mounted to the enclosure perimeter 110 via an adhesive such as adhesive 114 or by screws (not shown) or other suitable means known in the art.

Figure 7:
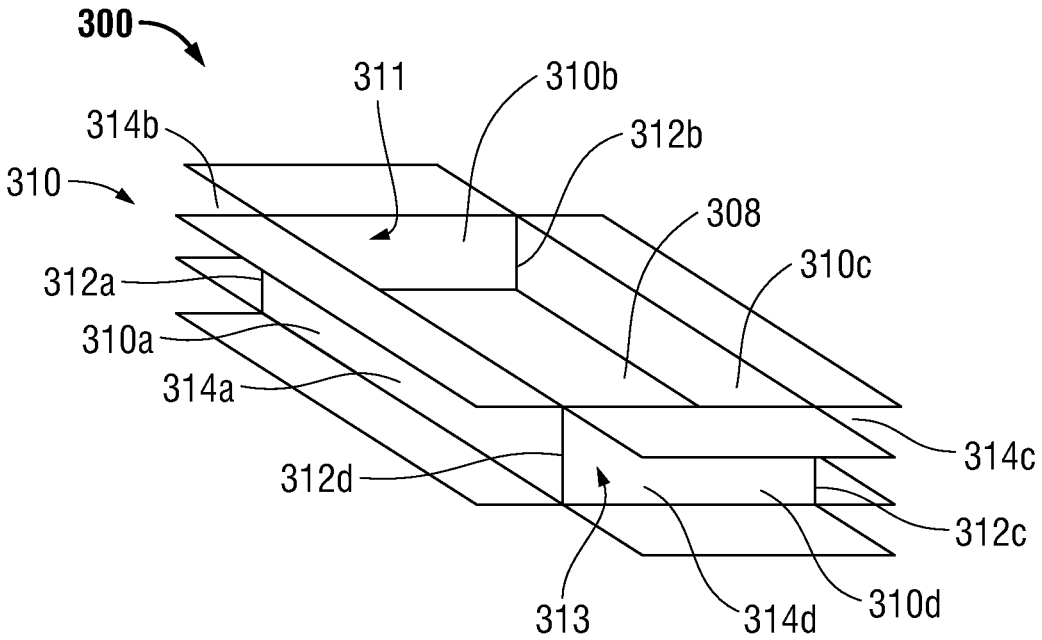
FIG. 7 is a perspective view of a storage receptacle structure configured for receiving a storage receptacle and for receiving a plurality of power strips or surge protectors mounted therein according to one embodiment of the present disclosure.

Turning now to FIG. 7, there is illustrated a power strip or surge protector support structure 300 that includes an enclosure perimeter 310 including an inner surface 311 and an opposite, outer surface 313. Inner surface 311 defines an aperture 308 configured and dimensioned for receiving a storage receptacle therein. The power strip or surge protector support structure is configured and dimensioned for receiving and supporting at least one power strip disposed on the enclosure perimeter 310. In the exemplary embodiment of FIG. 7, aperture 308 takes on a generally rectangular shape. Outer surface includes U-shaped channel members 310*a*, 310*b*, 310*c* and 310*d* that are joined together to form four corners. Corner 312*a* is formed between channel members 310*a* and 310*b*, corner 312*b* is formed between channel members 310*b* and 310*c*, corner 312*c* is formed between channel members 310*c* and 310*d* and corner 312*d* is formed between channel members 310*d* and 310*a*.

The U-shaped channel members 310*a*, 310*b*, 310*c* and 310*d* define respective apertures or cavities 314*a*, 314*b*, 314*c* and 314*d* that are each configured to receive a power strip or surge protector. It is contemplated that channel members 310*a*-*d* may assume a variety of shapes, such as, for example, squared, triangular, arcuate, or the like, to accommodate variously shaped surge protectors or power strips.

Figure 8:
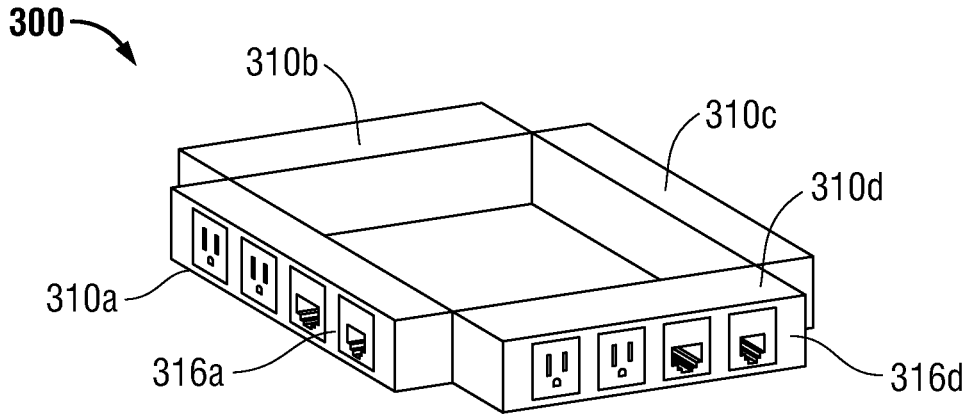
FIG. 8 illustrates the storage receptacle structure of FIG. 7 having a plurality of power strips or surge protectors mounted therein.

FIG. 8 illustrates the power strip or surge protector support structure 300 of FIG. 7 wherein a power strip or surge protector 316*a* is received within the aperture 314*a* of channel member 310*a* and power strip or surge protector 316*d* is received within the aperture 314*d* of channel member 310*d*. Other power strips or surge protectors, not shown, may be received within the apertures 314*b* and 314*c* of channel members 310*b* and 310*c*, respectively. Thus, the power strips or surge protectors 316*a* and 316*d* are mounted to the storage receptacle structure 300.

In a similar manner, the power strip or surge protector support structure 300 may be made preferably from an electrically insulating material and may be mounted to the enclosure perimeter 110 via an adhesive such as adhesive 114 or by screws (not shown) or other suitable means known in the art.

While the channel members 310*a* to 310*d* may be configured such that the power strips or surge protectors such as 316*a* and 316*d* are securely positioned within the channel members, the power strips or surge protectors such as 316*a* and 316*d* may be secured via the adhesive material 114 as illustrated in FIG. 4 and previously described. The adhesive material 114 may be applied, for example, between the power strips or surge protectors 316*a* and 316*d* and the base of the U-shaped channel members 310*a* and 310*d*, respectively.

Figure 9:
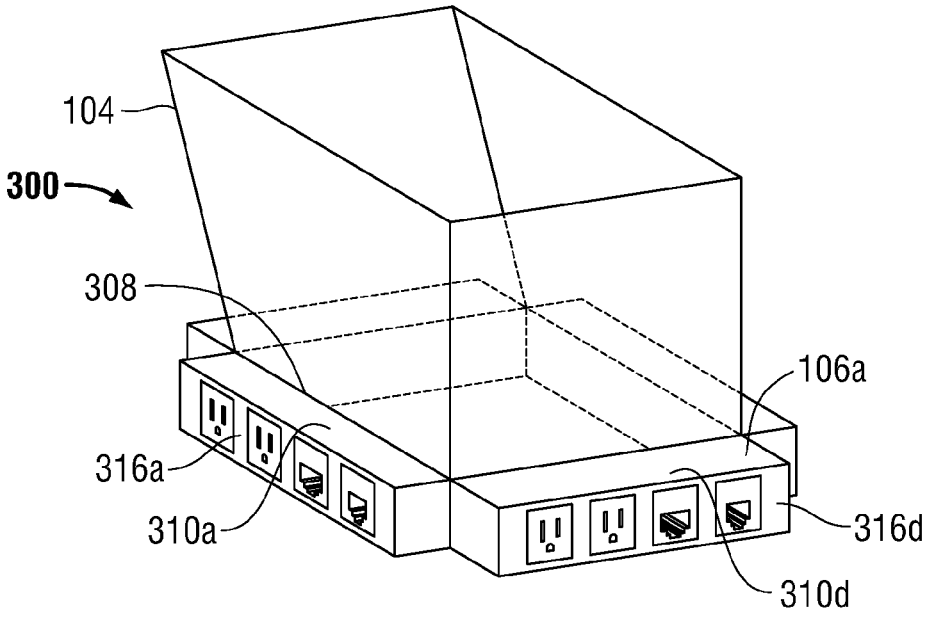
FIG. 9 illustrates the storage receptacle structure of FIG. 8 having a storage receptacle mounted through an aperture defined by the storage receptacle structure.

FIG. 9 illustrates the power strip or surge protector support structure 300 of FIG. 8 having a storage receptacle, such as storage receptacle 104 described above with respect to FIGS. 1-4, mounted through the aperture 308 defined by the power strip or surge protector support structure 300. More particularly, aperture 308 is configured and dimensioned to receive the base portion 106*a*. The storage receptacle 104 may be mounted in the power strip or surge protector support structure 300 either before or together with or after installation of the power strip or surge protectors such as power strip or surge protectors 316*a* and 316*d* are received within the apertures 314*a* and 314*d* of channel members 310 and 310*d*, respectively.

Figure 10:
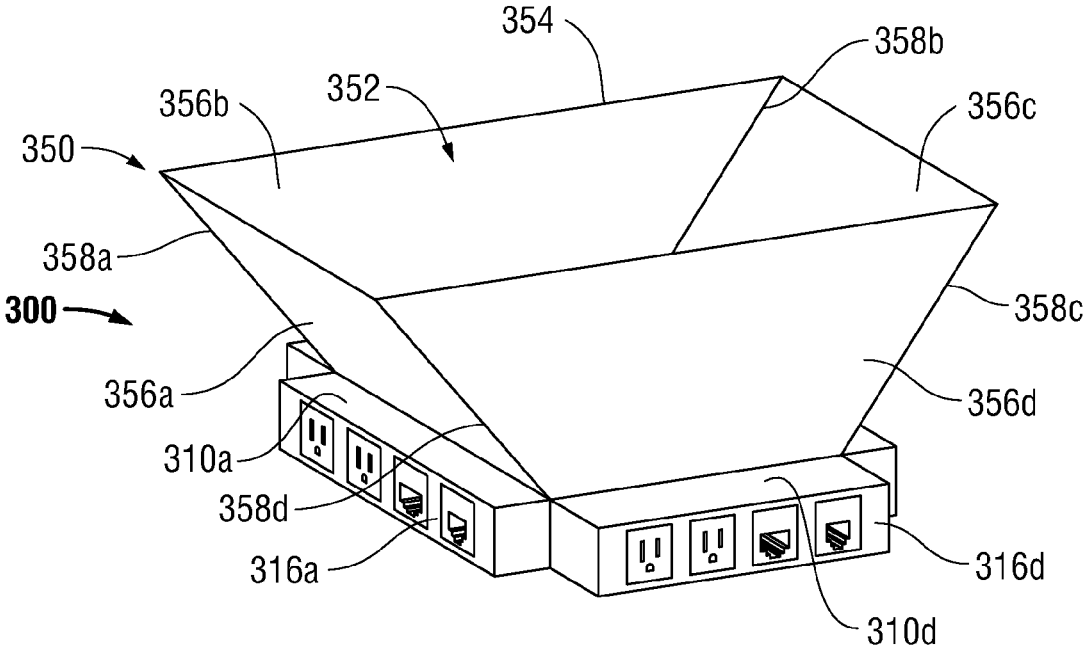
FIG. 10 illustrates the storage receptacle structure of FIG. 8 further including a shroud member dimensioned for receipt of a storage receptacle according to one embodiment of the present disclosure.

FIG. 10 illustrates the power strip or surge protector support structure 300 of FIG. 8 further including a shroud member 350 that is configured and dimensioned for receipt of a storage receptacle, e.g., storage receptacle 104 of FIGS. 1-4, according to one exemplary embodiment of the present disclosure. The shroud member 350 is configured and dimensioned to project an outwardly flared profile to define an aperture 352 at upper end 354. In the exemplary embodiment of FIG. 10, the shroud member 350 includes first, second, third and fourth trapezoidally shaped panel members 356*a*, 356*b*, 356*c* and 356*d*, respectively, that join together to form four corners.

The panel members 356*a*, 356*b*, 356*c* and 356*d* are disposed such that edges of the panel members 356*a*, 356*b*, 356*c* and 356*d* having the larger width form the upper end 354 to provide the outwardly flared profile. Corner 358*a* is formed between panel members 356*a* and 356*b*, corner 358*b* is formed between panel members 356*b* and 356*c*, corner 358*c* is formed between panel members 356*c* and 356*d*, and corner 358*d* is formed between panel members 356*d* and 356*a*. In the exemplary embodiment of FIG. 11, the aperture 352 exhibits a generally rectangular configuration for receiving the storage receptacle 104.

Figure 11:
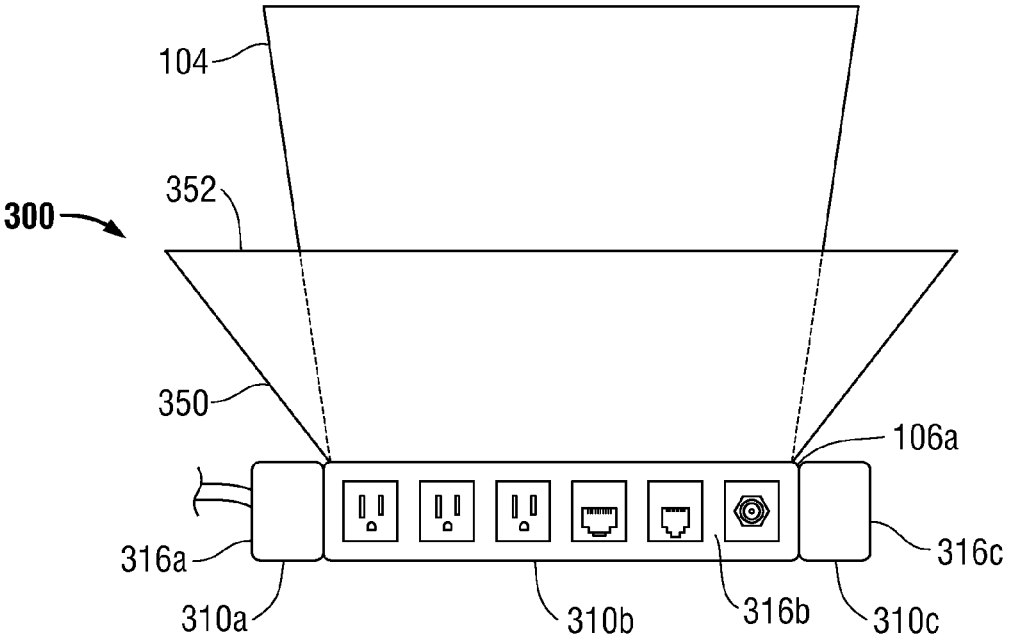
FIG. 11 is an elevation view of the storage receptacle structure of FIG. 10 wherein a storage receptacle is received by the storage receptacle structure via the shroud member.

Referring also to FIG. 11, by possessing the outwardly flared profile, the aperture 352 is sufficiently dimensioned such that the shroud member 350 enables guidance of the base portion 106*a* of the storage receptacle 104 for receipt by the power strip or surge protector support structure 300 described above with respect to FIGS. 7 and 8.

Thus, the shroud member 350 has a cross sectional dimension that is greater than a cross-sectional dimension of the storage receptacle 104 for receipt by the shroud member 350 such that the shroud member 350 enables direction of the storage receptacle 104 into the aperture 308 defined by the power strip or surge protector support structure 300. At least one power strip, e.g., power strips 102, 102', 112, 112', may be disposed and mounted on the power strip or surge protector support structure 300.

Figure 12A:
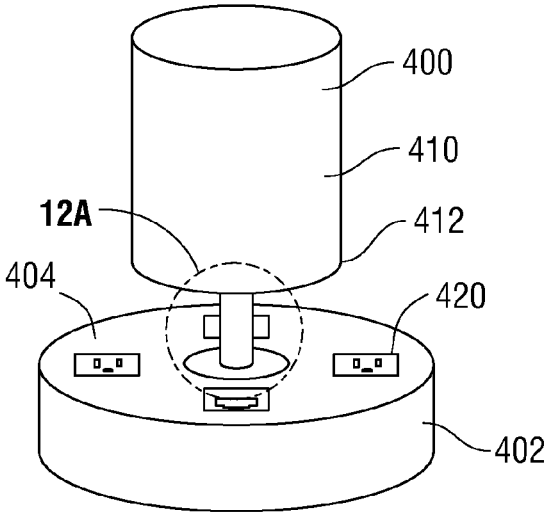
FIG. 12A is a perspective view of another storage receptacle mounted on another power strip or surge protector according to one embodiment of the present disclosure.

FIG. 12A illustrates another storage receptacle mounted on another power strip or surge protector according to one exemplary embodiment of the present disclosure. More particularly, storage receptacle 400, having a circular configuration, therefore defines a circular enclosure perimeter 410 having base portion 412. Circularly shaped power strip or surge protector 402 may include receptacles 420 for interfacing with equipment that is supplied electrical power or communications or optical networks via the power strip or surge protector, wherein the receptacles 420 are now facing vertically upward for user convenience. Upper surface 404 of the circularly shaped power strip or surge protector 402 may now be mounted to base portion 412 of the enclosure perimeter 410 of the storage receptacle 410.

Figure 12B:
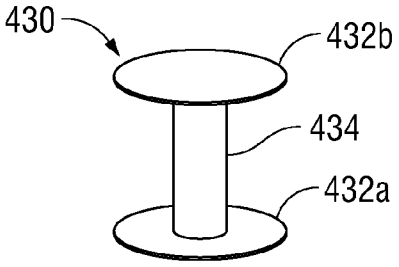
FIG. 12B illustrates a detail of FIG. 12A showing a support stand for the storage receptacle of FIG. 12A that supports the storage receptacle above the power strip or surge protector.

FIG. 12B illustrates a detail of FIG. 12A showing a support stand 430 for the circular storage receptacle 400 of FIG. 12A that supports the storage receptacle 400 above the power strip or surge protector 402. The support stand 430 includes a lower support plate 432*a* and an upper support plate 432*b* that are generally parallel to one another and joined by a rod 434 that is orthogonal to each support plate 432*a* and 432*b*. The upper support plate 432*b* is joined to the base portion 412 of the enclosure perimeter 410 of the storage receptacle 400 via an adhesive or screws (neither is shown) Similarly, the lower support plate 432*a* is joined to the upper surface of the power strip or surge protector 402 The rod 434 is of a sufficient length to enable the storage receptacle 400 to be elevated above the upper surface of the power strip or surge protector 402 for a user to conveniently access and plug into the receptacles 420.

Figure 13:
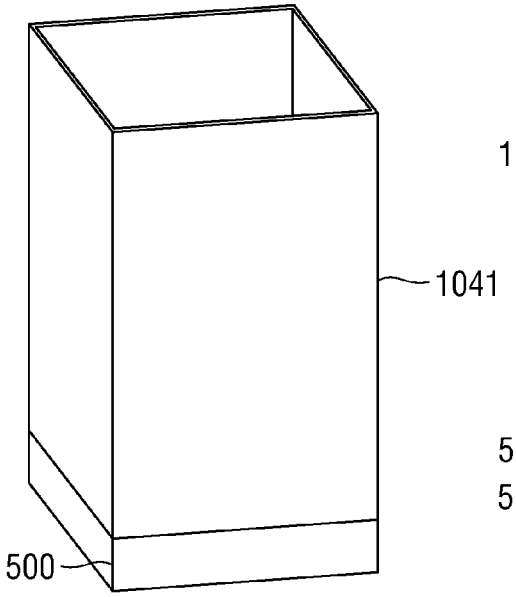
FIG. 13 is a perspective view of a storage receptacle mounted over a power strip or surge protector support structure that is configured for engaging with a storage receptacle that may include at least one power strip or surge protector mounted therein according to yet another embodiment of the present disclosure.

FIG. 13 is a perspective view of storage receptacle 1041 mounted over a power strip or surge protector support structure 5001 that is configured for engaging with the storage receptacle 104.

Figure 14:
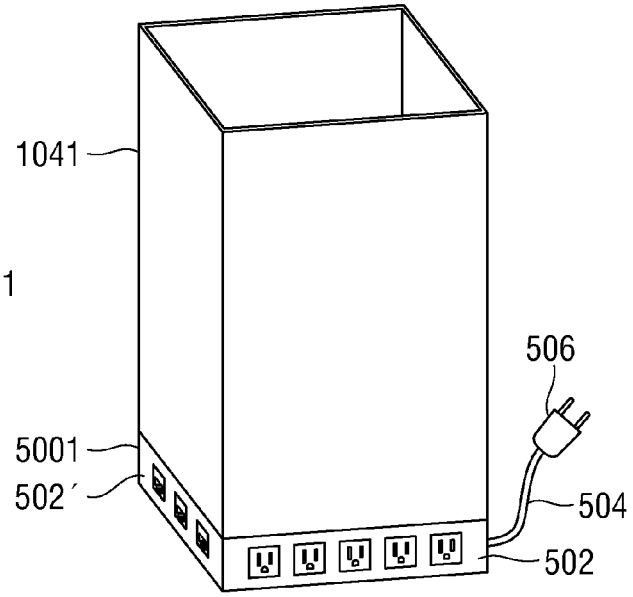
FIG. 14 is a perspective view of the storage receptacle of FIG. 13 mounted over the power strip or surge protector support structure of FIG. 13 which includes the plurality of power strips or surge protectors mounted therein on a side coincident with a side facing away from a user.

FIG. 14 is a perspective view of the storage receptacle of FIG. 13 mounted over the power strip or surge protector support structure 5001 of FIG. 13. The power strip or surge protector support structure 5001 includes at least one power strip or surge protector 502 or 502' mounted therein on a side of the storage receptacle 104 coincident with a side chosen by a user to face away from the user. The power strip or surge protectors 502 or 502' may include a power supply cord 502 and a power plug 504.

Figure 15:
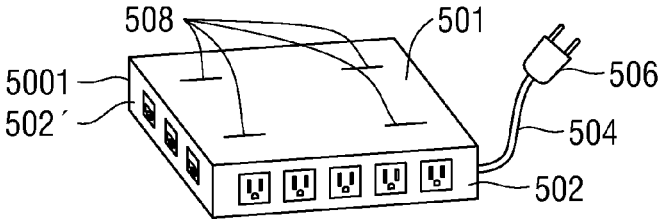
FIG. 15 is a perspective view of the power strip or surge protector support structure of FIGS. 13 and 14 which includes the plurality of power strips or surge protectors mounted therein and groove receptacles on the upper surface that are configured to removably engage with projections on the lower surface of the storage receptacle of FIGS. 13 and 14.

FIG. 15 is a perspective view of the power strip or surge protector support structure 5001 of FIGS. 13 and 14 which includes the plurality of power strips or surge protectors 502 or 502' mounted therein and groove receptacles 508 on upper surface 510 that are configured to removably engage with projections on the lower surface of the storage receptacle 1041 of FIGS. 13 and 14.

Figure 16:
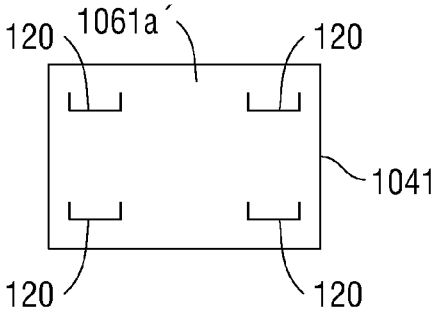
FIG. 16 is view of the lower or bottom surface of the storage receptacle of FIGS. 13 and 14 illustrating projections that are removably engageable with the groove receptacles of FIG. 15.

FIG. 16 is view of the lower or bottom surface 1061*a*' of the storage receptacle 1041 of FIGS. 13 and 14 illustrating projections 120 that are removably engageable with the groove receptacles 508 of FIG. 15.

Figure 17:
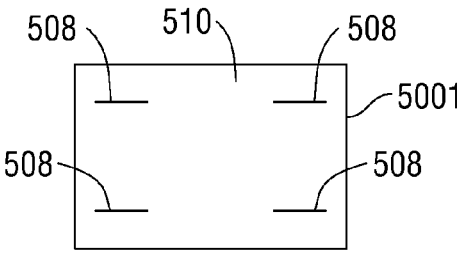
FIG. 17 is a plan view of the power strip or surge protector support structure of FIGS. 13-15 illustrating the groove receptacles on the upper surface that are configured to removably engage with the projections on the lower or bottom surface of the storage receptacle of FIG. 16.
Figure 18:
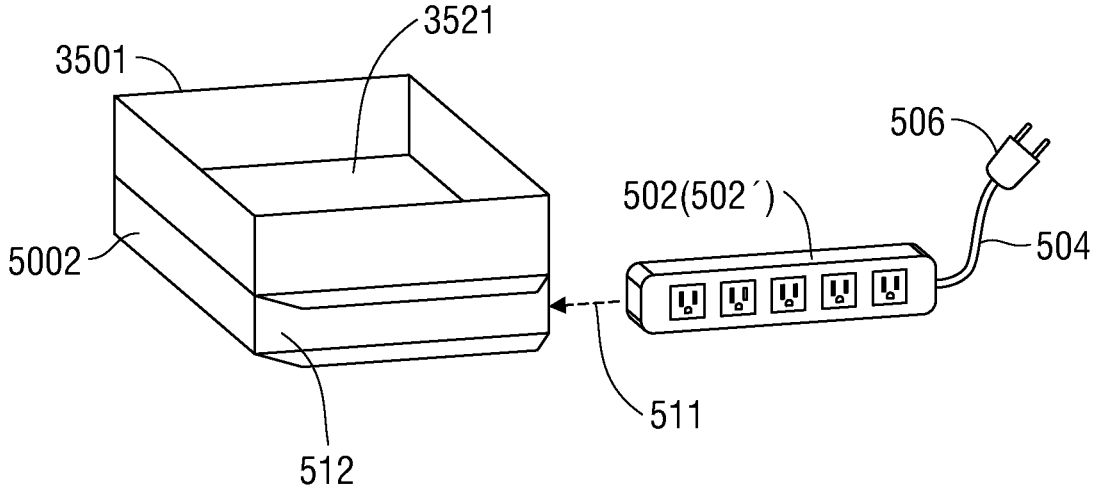
FIG. 18 is a perspective view illustrating a power strip or surge protector support structure and a power strip or surge protector positioned to be received by the power strip or surge protector support structure and further including a shroud member dimensioned for receipt of a storage receptacle according to one embodiment of the present disclosure.

FIG. 17 is a plan view of the power strip or surge protector support structure 5001 of FIGS. 13-15 illustrating the groove receptacles 508 on the upper surface 510 that are configured to removably engage with the projections 120 on the lower or bottom surface 1061*a*' of the storage receptacle 1041 of FIG. 16;

FIG. 18 is a perspective view illustrating a power strip or surge protector support structure 5002 which illustrates at least one power strip or surge protector 502 or 502' positioned to be received, in the direction of arrow 511, by the U-channel 512 of the power strip or surge protector support structure 5002 and further including shroud member 3501 that is again dimensioned for receipt of a storage receptacle such as storage receptacle 104 of FIGS. 1-6, 9 and 11 according to one embodiment of the present disclosure. Again, the shroud member 3501 defines aperture 3521 that may be configured in a rectangular profile to generally conform to the rectangular shape of lower or bottom surface 106*a*' of storage receptacle 104 (see FIG. 4).

It should be understood also that the various power strip or surge protector support structures 5001 to 5005 may be provided without the groove receptacles 508 so that the power strip or surge protector support structures 5001 to 5005 may be employed by a user regardless of whether or not a storage receptacle is mounted thereto. Thus the various power strip or surge protector support structures 5001 to 5005 may be utilized independently as power strip or surge protector support structures. In addition, those skilled in the art will recognize from the foregoing description of FIGS. 1-12B and reference thereto that the present disclosure relates also to a method of deploying a power strip that includes providing a storage receptacle, e.g., storage receptacle 104 in FIGS. 1-4 or storage receptacle 400 in FIGS. 12-12B, that includes an enclosure perimeter, e.g., enclosure perimeter 110, and mounting at least one power strip, e.g., power strip or surge protectors 102, 102', 112 or 112' as shown in FIG. 4, to the enclosure perimeter 110.

The mounting step may include mounting the one or more power strips or surge protectors, e.g., power strip or surge protectors 102, 102', 112 or 112', to the enclosure perimeter 110 via an adhesive material, e.g., adhesive material 114 illustrated in FIG. 4.

The method may include mounting the one or more power strips or surge protectors, e.g., power strip or surge protectors 102, 102', 112 or 112', to the enclosure perimeter, e.g., enclosure perimeter 110, such that at least one storage receptacle structure, e. g., storage receptacle structure 300 in FIGS. 8-11, is mounted to the enclosure perimeter 110 and the one or more power strip or surge protectors 102, 102', 112 or 112' is mounted to the storage receptacle structure 300.

With reference to FIGS. 19-33, an embodiment of a receptacle assembly is provided and designated using reference numeral 600. Receptacle assembly 600 can act as both a receptacle for receiving objects therein and for providing power to appliances, as will be described in detail below.

Receptacle assembly 600 generally includes a receptacle 602, a surge protector or a power strip 616, a barrier 620, and a base station 640. With reference to FIGS. 19-22, receptacle 602 of receptacle assembly 600 has a generally rectangular configuration and has a top portion 604*a* and a bottom portion 604*b*. In some embodiments, receptacle 602 may assume a variety of shapes and configurations, such as, for example, rounded, triangular, tapered, oblong, polygonal, uniform, non-uniform, star-shaped, or the like. Top portion 604*a* defines a cavity 606 therein configured for receipt of objects or materials, such as, for example, waste. Top portion 604*a* has an upper rim 608 that defines an opening 610 that is in communication with cavity 606.

Bottom portion 604*b* of receptacle 602 is connected to top portion 604*a* and forms a bottom of receptacle 602. In some embodiments, bottom portion 604*b* may be integrally connected to or monolithically formed with top portion 604*a*. Bottom portion 604*b* has a smaller overall transverse cross-sectional area than a transverse cross-sectional area of top portion 604*a* such that top portion 604*a* has a seating surface 612 formed adjacent bottom portion 604*b*.

With reference to FIGS. 19 and 23-25, barrier 620 of receptacle assembly 600 is configured to be interposed between receptacle 602 and base station 640. Barrier 620 defines a cavity 622 therein configured for removable receipt of bottom portion 604*b* of receptacle 602. Bottom portion 604*b* of receptacle 606 is configured to frictionally engage or snap-fittingly engage barrier 620. Barrier 620 has a base 624 and a wall 626 extending substantially perpendicularly upward from base 624. Base 624 and wall 626 cooperatively define the boundary of cavity 622 of barrier 620.

Barrier 620 of receptacle assembly 600 further includes a ledge 628 extending outwardly from a top end of wall 626. As such, upon receipt of bottom portion 604*b* of receptacle 602 within cavity 622 of barrier 620, seating surface 612 of top portion 604*a* of receptacle 602 abuts ledge 628 of barrier 620. Barrier 620 further includes a plurality of fingers 630 extending from ledge 628 of barrier 620. Adjacent fingers 630 define a space 632 therebetween configured for passage of an electric cord 618 of power strip 616.

With reference to FIGS. 19 and 26-29, base station 640 of receptacle assembly 600 is configured to house power strip 616 therein or to have power strip 616 be coupled thereto. Base station 640 defines a cavity 642 therein configured to removably receive barrier 620 and bottom portion 604*b* of receptacle 602. Barrier 620 can be fixedly attached to base station 640 via fastening members 643 (FIG. 19) when barrier 620 is disposed within cavity 642 of base station 640. Base station 640 includes an underside 644 and a wall 646 extending substantially perpendicularly upward from underside 644. Underside 644 and wall 646 cooperatively define the boundary of cavity 642 of base station 640.

Wall 646 of base station 640 is comprised of four, interconnected side surfaces 648 that form a generally rectangular configuration. Other configurations of wall 646 are contemplated, such as, for example, the alternate configurations described above. Side surface 648 of wall 646 defines an opening or aperture 650 therethrough configured for receipt of power strip 616. Opening 650 is in communication with cavity 642 of base station 640. It is contemplated that power strip 616 may not be passable through opening 650 and, instead, opening 650 may merely provide access to power strip 616 from outside of receptacle assembly 600.

Underside 644 of base station 640 protrudes downwardly from wall 646 of base station 640 and defines a cavity, such as, for example, a hollow core 652 therein. Underside 644 defines a plurality of channels 654 each extending from hollow core 652 and laterally outward to an outer surface or perimeter 656 of underside 644. Channels 654 are configured for removable and/or slidable receipt of electric cord 618 of power strip 616.

Base station 640 further includes a cylindrical extension 660 projecting centrally through hollow core 652 of underside 644. Cylindrical extension 660 is configured to have electric cord 618 wrapped therearound such that electric cord 618 can be housed within hollow core 652, within base station 640. Cylindrical extension 660 has a first end 662*a* in communication with cavity 642 of wall 646 of base station 640 and a second end 662*b* in communication with hollow core 652 of underside 644 of base station 640. Cylindrical extension 660 defines a central passageway 664 longitudinally therethrough. Passageway 664 has a first opening 666*a* formed in first end 664*a* of cylindrical extension 660 and a second opening 666*b* formed in second end 664*b* of cylindrical extension 660. Passageway 664, including first and second openings 666*a*, 666*b* thereof, are configured to receive electric cord 618 such that electric cord 618 can be passed from cavity 642 of wall 646 of base station 640, through passageway 664, and into hollow core 652 of underside 644 of base station 640.

Cylindrical extension 660 has a flange 668 extending radially from second end 662*b* of cylindrical extension 660. Cylindrical extension 660 of base station 640 further defines a plurality of slits 670 extending longitudinally therethrough. Slits 670 extend through flange 668 to segment flange 668 into a plurality of sector-shaped flanges. Slits 670 are disposed about passageway 664 of cylindrical extension 660 and are configured for passage of electric cord 618. As such, electric cord 618 can be passed from cavity 642 of wall 646 of base portion 640, through passageway 664 of cylindrical extension 660, out of one of slits 670 of cylindrical extension 660, and into hollow core 652 to be wrapped around cylindrical extension 660. When electric cord 618 is wrapped around cylindrical extension 660, electric cord 618 is prevented from falling out of hollow core 652 by flange 668 of cylindrical extension 660.

Figure 29:
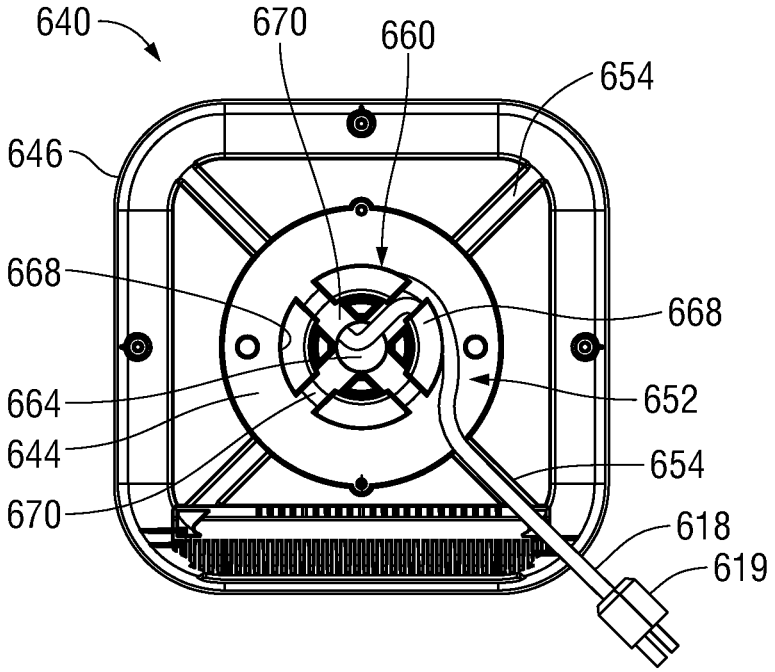
FIG. 29 is an enlarged view of the bottom of the base station of FIG. 19 including a power cord.
Figure 30:
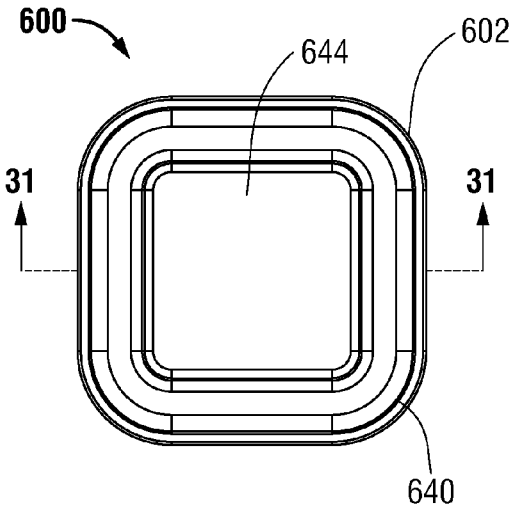
FIG. 30 is a plan view of a bottom of the receptacle assembly of FIG. 19 in its assembled state.
Figure 31:
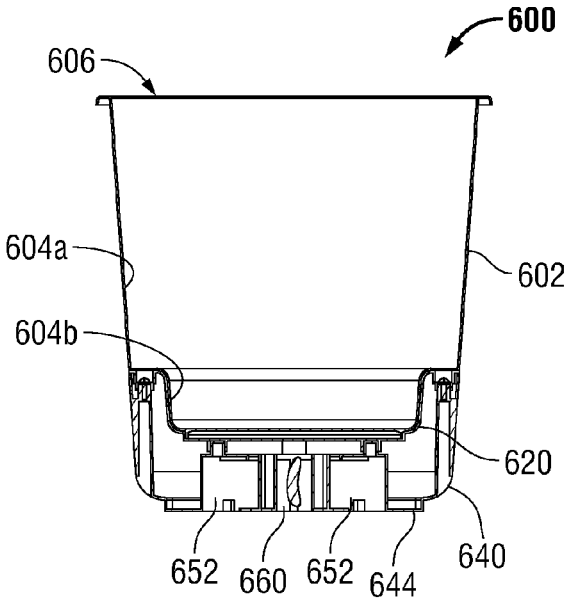
FIG. 31 is a cross section, taken along line 31-31 in FIG. 30, of the receptacle assembly.
Figure 32:
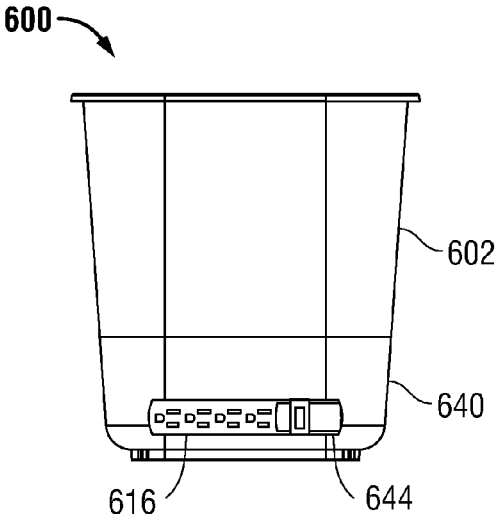
FIG. 32 is a side view of the receptacle assembly of FIG. 19 in its assembled state.
Figure 33:
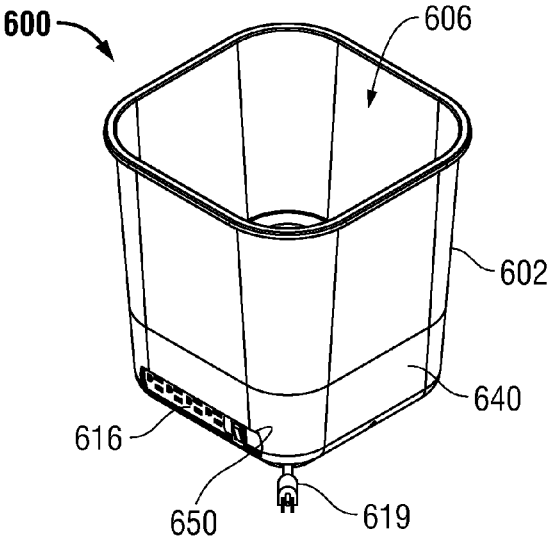
FIG. 33 is a perspective view of the receptacle assembly of FIG. 19 in its assembled state.

Slits 670 each define a longitudinal axis and channels 654 of underside 644 each define a longitudinal axis. The longitudinal axes of slits 670 are substantially perpendicular to the longitudinal axes of channels 654 and in alignment therewith. In this way, as illustrated in FIGS. 29 and 33, when electric cord 618 is at least partially unraveled from cylindrical extension 660, electric cord 618 can be extended in a straight configuration from one of slits 670 of cylindrical extension 660 and through one of channels 654 of underside 644 to be exposed from base station 600.

With reference to FIGS. 19 and 30-33, receptacle assembly 600 may be assembled by positioning power strip 616 within cavity 642 defined by wall 646 of base station 640 and disposed adjacent or within opening 650 defined through side 648 of wall 646 of base station 640. Electric cord 618 can be passed through passageway 664 of cylindrical extension 660 and into hollow core 652 of underside 644. Electric cord 618 may be wrapped around cylindrical extension 660 to house electric cord 618 within hollow core 652 of base station 640. Alternately, electric cord 618 may be passed from hollow core 652 and through one of channels 654 of underside 644 to allow a plug 619 of electric cord 618 to be inserted into an outlet (not shown).

Figure 19:
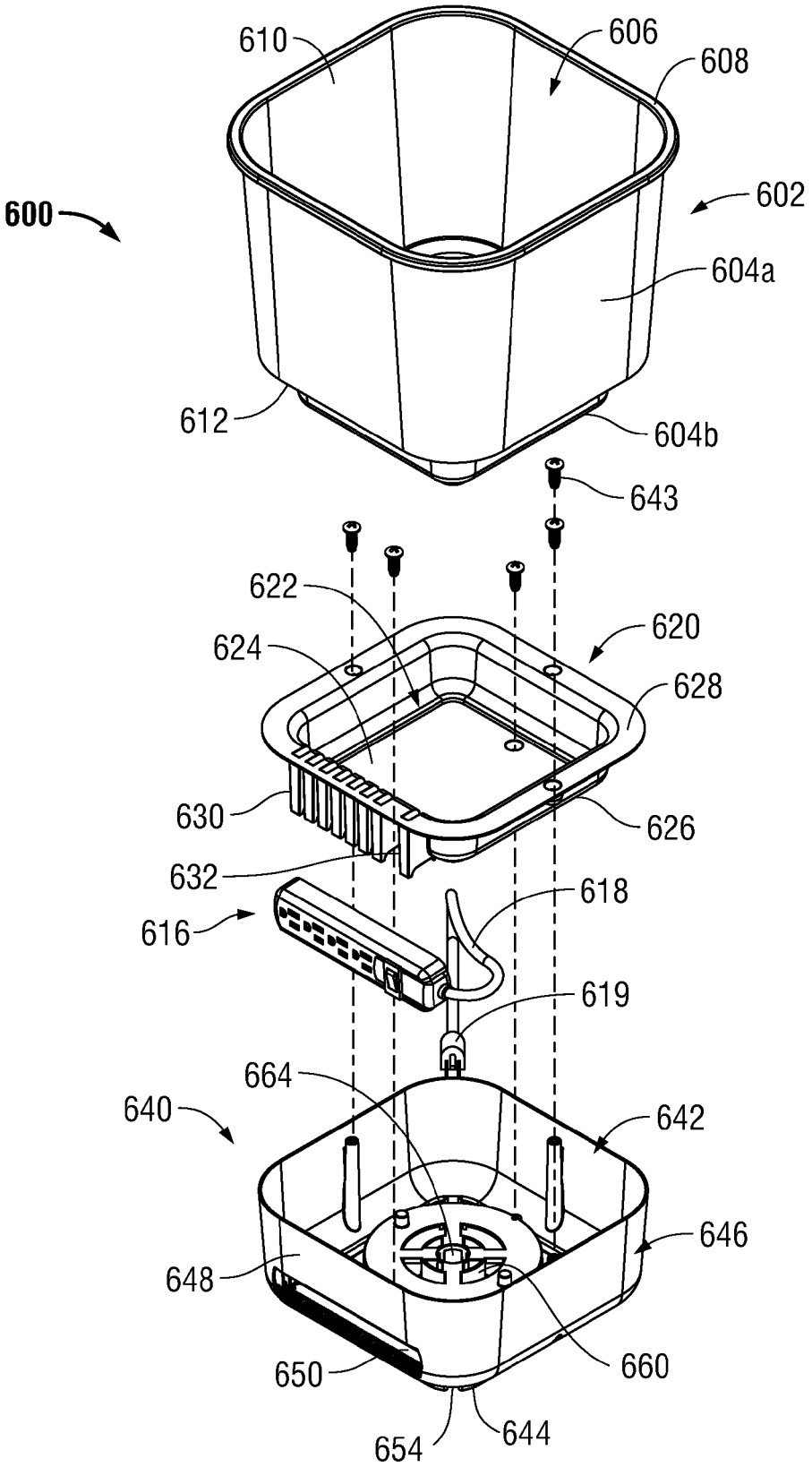
FIG. 19 is a perspective view, with parts separated, of an embodiment of a receptacle assembly including a receptacle, a barrier, a surge protector, and a base station.
Figure 20:
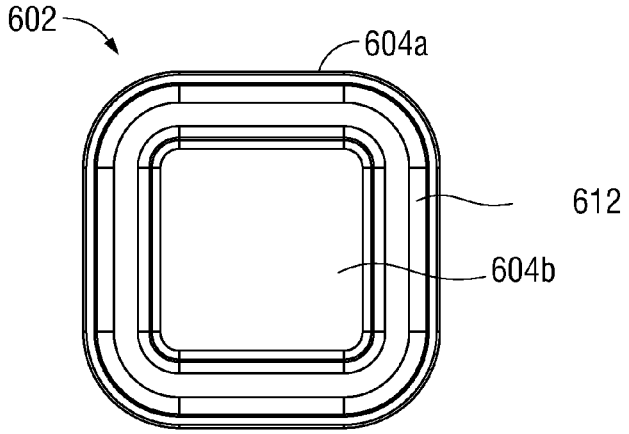
FIG. 20 is a plan view of a bottom of the receptacle of FIG. 19.
Figure 21:
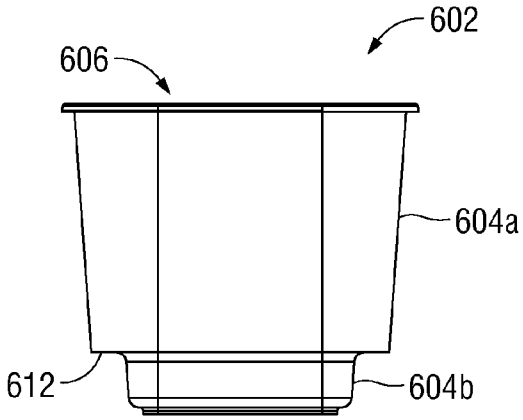
FIG. 21 is a side view of the receptacle of FIG. 19.
Figure 22:
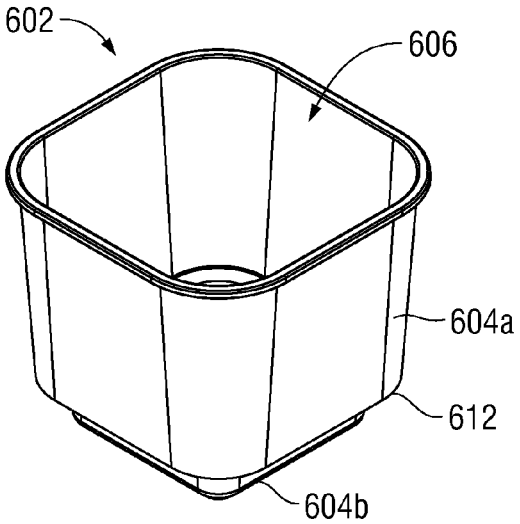
FIG. 22 is a perspective view of the receptacle of FIG. 19.
Figure 23:
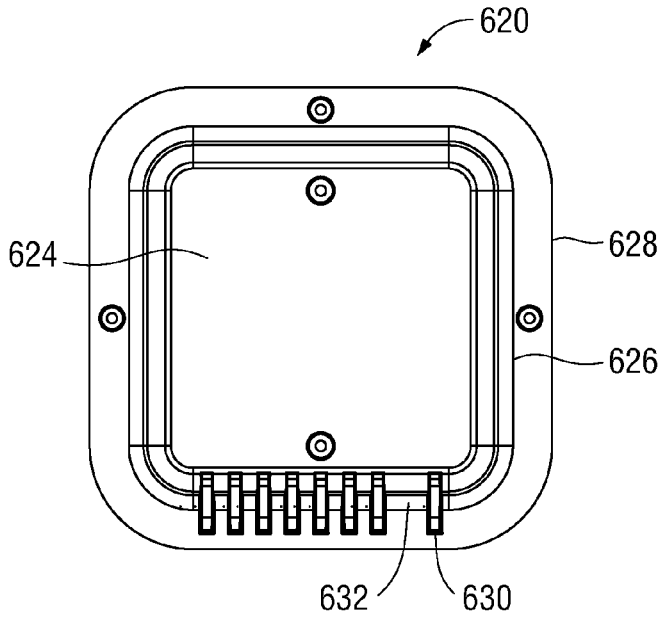
FIG. 23 is a plan view of a bottom of the barrier of FIG. 19.
Figure 24:
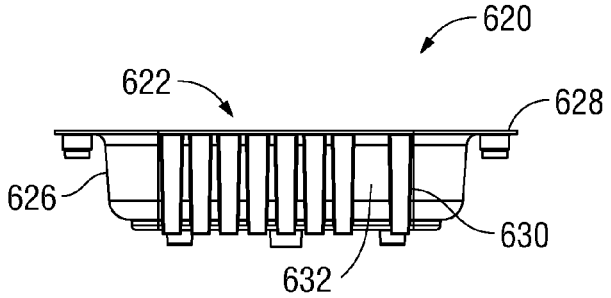
FIG. 24 is a side view of the barrier of FIG. 19.
Figure 25:
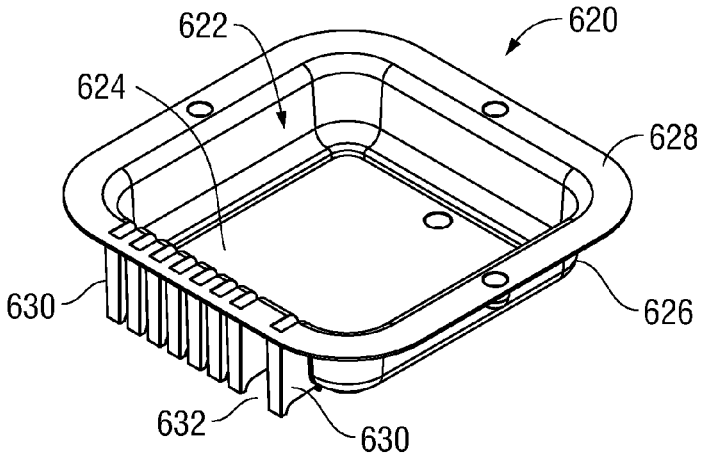
FIG. 25 is a perspective view of the barrier of FIG. 19.
Figure 26:
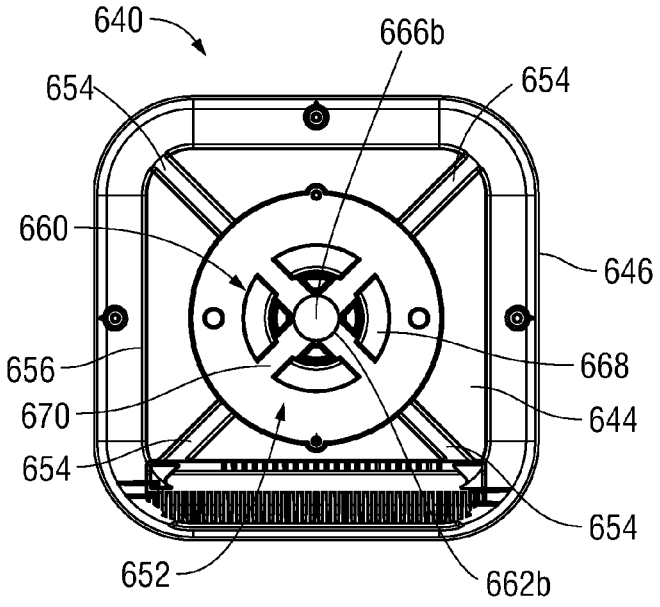
FIG. 26 is a plan view of a bottom of the base station of FIG. 19.
Figure 27:
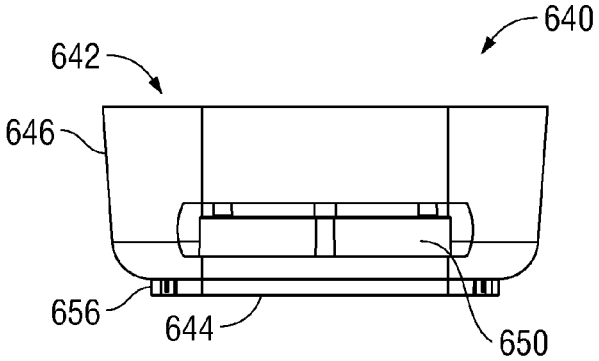
FIG. 27 is a side view of the base station of FIG. 19.
Figure 28:
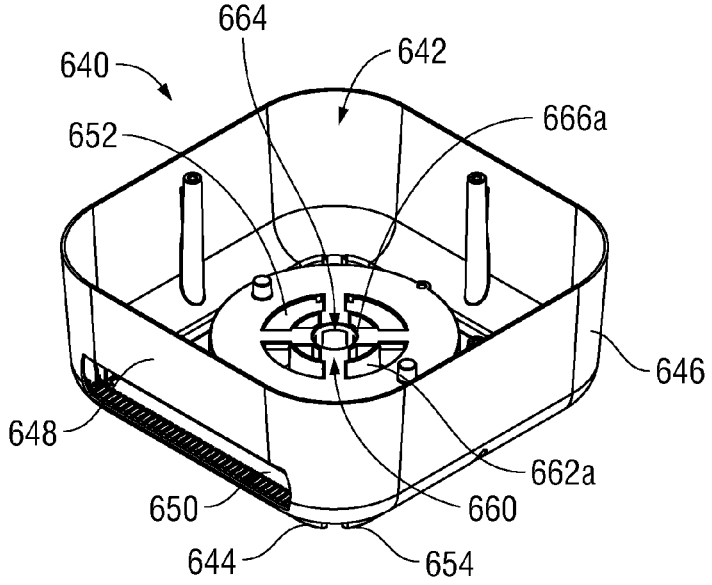
FIG. 28 is a perspective view of the base station of FIG. 19.

With power strip 616 suitably positioned within base station 640, barrier 620 of receptacle assembly 600 may be positioned within cavity 642 of wall 646 of base station 640 to engage fingers 630 of barrier 620 with a back-side of power strip 616, thus securing power strip 616 between wall 646 of base station 640 and barrier 620 while allowing power strip 616 to be accessed through opening 650. Barrier 620 may be fastened to base station 640 using fastening members 643 (FIG. 19). With barrier 620 secured within base station 640, receptacle 602 may be positioned within cavity 622 of barrier 620 to removably secure receptacle 602 to base station 640. As such, receptacle assembly 600 can be used as both a receptacle for receiving objects (e.g., waste) in receptacle 602, and for connecting appliances to a power supply via power strip 616.

If removal of objects from receptacle 602 is desired, receptacle 602 may be selectively disconnected from base portion 640 due to receptacle 602 being detachably coupled to base station 640. Once detached from base station 640, receptacle 602 may be emptied or moved to another location.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope of the claims appended hereto.

What is claimed is:

1. A storage receptacle assembly, comprising:

a storage receptacle;

an enclosure perimeter defining an aperture for receiving the storage receptacle therein;

at least one mounting structure coupled to and surrounding the enclosure perimeter, said at least one mounting structure having four sides and a height which is less than 50% of the height of the storage receptacle, each side having one of an L-configuration and a C-configuration; and at least one power strip configured to be received by the L-configuration or the C-configuration of the mounting structure such that the at least one power strip is mounted to the at least one mounting structure.

2. The storage receptacle assembly according to claim 1, wherein the aperture defined by the enclosure perimeter has at least one of:

a generally rectangular configuration; and a generally circular configuration.

3. The storage receptacle assembly according to claim 1, wherein the storage receptacle is removably disposed within the aperture of the enclosed perimeter.

4. The storage receptacle assembly according to claim 1, further comprising a shroud member disposed within an aperture of the enclosure perimeter and configured to direct a storage receptacle into the enclosure perimeter.

5. The storage receptacle assembly according to claim 1, wherein each C-configuration or L-configuration side includes a channel member connected to an adjacent channel member to form a rectangular configuration, each channel member of the four channel members configured for receipt of a rectangular power strip.

6. A receptacle assembly, comprising:

a receptacle having a top portion and a bottom portion, the top portion defining a cavity therein;

at least one of a power strip or a surge protector; and a base station configured to have the at least one of the power strip or the surge protector mounted thereto, the base station further configured to be coupled to the bottom portion of the receptacle;

wherein the base station includes:

an underside; and a wall extending upwardly from the underside, the wall defining a cavity therein configured for receipt of the bottom portion of the receptacle;

wherein the underside of the base station defines a cavity therein, the base station further including a cylindrical extension disposed within the cavity of the underside and configured to have an electric cord of the at least one of the power strip or the surge protector wrapped thereabout;

wherein the cylindrical extension defines at least one longitudinally extending slit and includes a radially extending flange, the flange configured to retain the electric cord within the cavity of the underside; and wherein the underside of the base station defines at least one channel therein extending laterally from the cavity of the underside to an outside surface of the underside, the at least one channel configured for receipt of the electrical cord.

7. The receptacle assembly according to claim 6, wherein the bottom portion of the receptacle is detachably coupled to the base station.

8. The receptacle assembly according to claim 6, wherein the wall has a side surface that defines at least one opening therethrough configured for receipt of the at least one of the power strip or the surge protector, the at least one opening being in communication with the cavity of the receptacle.

9. The receptacle assembly according to claim 6, wherein the at least one channel of the underside is perpendicular to the at least one longitudinally extending slit and in alignment therewith.

10. The receptacle assembly according to claim 6, further comprising a barrier configured for receipt within the base station and in engagement with the at least one of the surge protector or the power strip, the barrier defining a cavity therein configured for removable receipt of the bottom portion of the receptacle.

11. The receptacle assembly according to claim 10, wherein the barrier has a plurality of fingers configured to engage the at least one of the surge protector or the power strip, adjacent fingers of the plurality of fingers defining a space therebetween configured for passage of an electric cord of the at least one of the surge protector or the power strip.

12. A receptacle assembly, comprising:

a receptacle having a top portion and a bottom portion, the top portion defining a cavity therein;

at least one of a power strip or a surge protector;

a base station configured to have the at least one of the power strip or the surge protector mounted thereto, the base station further configured to be coupled to the bottom portion of the receptacle; and a barrier configured for receipt within the base station and in engagement with the at least one of the surge protector or the power strip, the barrier defining a cavity therein configured for removable receipt of the bottom portion of the receptacle, wherein the barrier has a plurality of fingers configured to engage the at least one of the surge protector or the power strip.

13. The receptacle assembly according to claim 12, adjacent fingers of the plurality of fingers defining a space therebetween configured for passage of an electric cord of the at least one of the surge protector or the power strip.

14. The receptacle assembly according to claim 12, wherein the base station includes:

an underside; and a wall extending upwardly from the underside, the wall defining a cavity therein configured for receipt of the bottom portion of the receptacle.

15. The receptacle assembly according to claim 14, wherein the wall has a side surface that defines at least one opening therethrough configured for receipt of the at least one of the power strip or the surge protector, the at least one opening being in communication with the cavity of the receptacle.

16. The receptacle assembly according to claim 14, wherein the underside of the base station defines a cavity therein, the base station further including a cylindrical extension disposed within the cavity of the underside and configured to have an electric cord of the at least one of the power strip or the surge protector wrapped thereabout.

17. The receptacle assembly according to claim 16, wherein the cylindrical extension defines a passageway therethrough having a first opening in communication with the cavity of the wall and a second opening in communication with the cavity of the underside, the passageway configured for passage of the electric cord.

18. The receptacle assembly according to claim 16, wherein the cylindrical extension defines at least one longitudinally extending slit and includes a radially extending flange, the flange configured to retain the electric cord within the cavity of the underside.

19. The receptacle assembly according to claim 18, wherein the underside of the base station defines at least one channel therein extending laterally from the cavity of the underside to an outside surface of the underside, the at least one channel configured for receipt of the electrical cord.

20. The receptacle assembly according to claim 19, wherein the at least one channel of the underside is perpendicular to the at least one longitudinally extending slit and in alignment therewith.

* * * * *